US006457749B1

(12) United States Patent
Heijnen

(10) Patent No.: US 6,457,749 B1
(45) Date of Patent: Oct. 1, 2002

(54) LOCK ASSEMBLY

(75) Inventor: Wilhelmus Hubertus Paulus Maria Heijnen, Nienhagen (DE)

(73) Assignee: Shell Oil Company, Houston, TX (US)

( * ) Notice: Subject to any disclaimer, the term of this patent is extended or adjusted under 35 U.S.C. 154(b) by 71 days.

(21) Appl. No.: 09/713,054

(22) Filed: Nov. 15, 2000

(30) Foreign Application Priority Data

Dec. 21, 2000 (EP) ..... 99309113
Jan. 22, 2001 (EP) ..... 99309153

(51) Int. Cl.[7] ..... F16L 37/00
(52) U.S. Cl. ..... 285/307; 285/308; 285/922
(58) Field of Search ..... 285/305, 187, 285/307, 308, 309, 323, 381.2, 381.1, 381.3, 922, 35

(56) References Cited

U.S. PATENT DOCUMENTS 2,849,245 A * 8/1958 Baker ..... 285/922 X
2,980,185 A * 4/1961 Daffin ..... 285/922 X
3,037,797 A * 6/1962 Brown ..... 285/922 X
3,051,244 A * 8/1962 Litchfield ..... 285/922 X
4,138,148 A * 2/1979 Zaremba ..... 285/922 X
4,452,472 A * 6/1984 Crase ..... 285/922 X
4,453,745 A * 6/1984 Nelson ..... 285/381.1 X
4,488,740 A * 12/1984 Baugh et al. ..... 285/308 X
4,903,992 A * 2/1990 Jennings et al. ..... 285/307 X
5,020,593 A * 6/1991 Milberger ..... 285/922 X
5,160,172 A * 11/1992 Gariepy ..... 285/922 X

* cited by examiner

*Primary Examiner*—Eric K. Nicholson
*Assistant Examiner*—David E. Bochna

(57) ABSTRACT

A lock assembly for locking an outer tubular element to an inner tubular element extending through the outer tubular element for holding loads between the tubular member when lowered downhole. The assembly includes a lock mandrel connected to one of the tubular elements and the other tubular element having a recess with at least one inwardly converging side surface. A lock member, having a retracted and an expanded mode, is arranged between the first and second tubular elements. The lock member is movable relative to the recess in the retracted mode and locks against the inwardly diverging side surface when in the expanded mode.

9 Claims, 2 Drawing Sheets

LOCK ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION (1) Field of the Invention

The present invention relates to a lock assembly for locking an outer tubular element to an inner tubular element extending through the outer tubular element. Such lock assemblies are, for example, applied in a wellbore for the production of hydrocarbon fluid from an earth formation. In such application the outer tubular element can be connected to (or integrally formed with) the wellbore casing or a wellbore production tubing, and the inner tubular element is adapted to receive a wellbore device (e.g. a valve).

(2) Background of the Invention

A problem with such applications comes to light when the lock assembly is subjected to longitudinal forces. For example, when the inner element is subjected to a longitudinal force due to fluid pressure of produced hydrocarbon fluid, such force can lead to relative movement between the two elements leading to loosening of the lock connection. Furthermore, such relative movement prevents adequate transmission of signals, e.g. acoustic or electric signals, between the inner and outer tubular elements. A further problem occurs with applications involving conventional dog and lock shoulders whereby the inner tubular element is subjected to radially inward forces upon application of a pulling force, thus requiring an increased wall thickness of the inner tubular element.

Accordingly it is an object of the invention to provide an improved lock assembly which overcomes the problems of the conventional lock assemblies.

BRIEF SUMMARY OF THE INVENTION

In accordance with the invention there is provided a lock assembly for locking an outer tubular element to an inner tubular element extending through the outer tubular element, the assembly comprising a lock mandrel connected to one of said tubular elements and being provided with a recess facing the other one of said tubular elements, the recess having at least one inwardly diverging side surface, a lock member arranged between the first and second tubular elements in a locking relationship with the other one of the tubular elements, the lock member extending into said recess and being operable between a retracted mode in which the lock member is movable relative to the recess and an expanded mode in which the lock member is expanded against the inwardly diverging side surface, the assembly further comprising an actuator means for expanding the lock member in said recess against said diverging side surface.

It is thereby achieved that when the lock member is in the expanded mode, a load applied to the lock assembly, e.g. a longitudinal pulling force, induces the lock member to become even more firmly locked in the recess due to the inwardly diverging side surface of the recess. Thereby the locking action of the assembly is enhanced. Furthermore, it is thereby ensured that the inner and outer elements are in firm contact with each other allowing adequate transmission of electric or acoustic signals.

BRIEF DESCRIPTION OF THE DRAWINGS

The invention will be described hereinafter in more detail with reference to the accompanying drawings in which.

In the detailed description below like reference numerals relate to like components.

DETAILED DESCRIPTION OF THE PREFERRED EMBODIMENT

Figure 1:
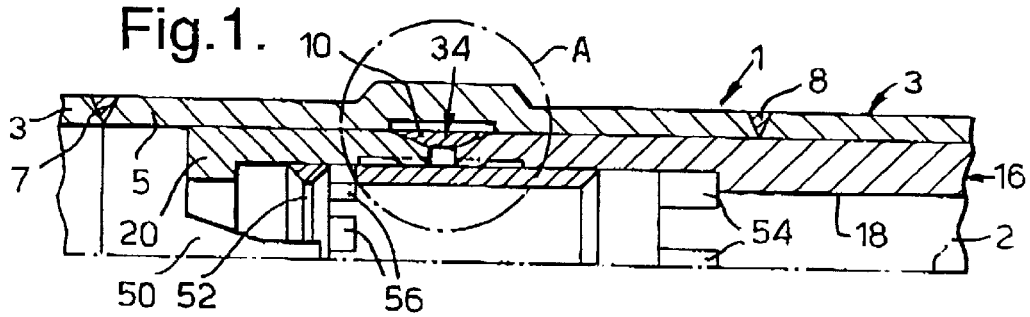
FIG. 1 schematically shows a first embodiment of a wellbore assembly according to the invention.

Referring to FIG. 1 there is shown a lock assembly 1 extending in a wellbore (not shown) formed in an earth formation, the assembly 1 having a central longitudinal axis 2 substantially coinciding with the with the longitudinal axis of the wellbore. The lock assembly is symmetrical with respect to axis 2, therefore only one half of the lock assembly is shown in FIG. 1. The lock assembly includes an outer tubular element in the form of a wellbore casing 3 arranged in the wellbore. A lock mandrel 5 is connected to the casing 3 by welds 7, 8 so as to form an integral part of the casing 3.

Figure 2:
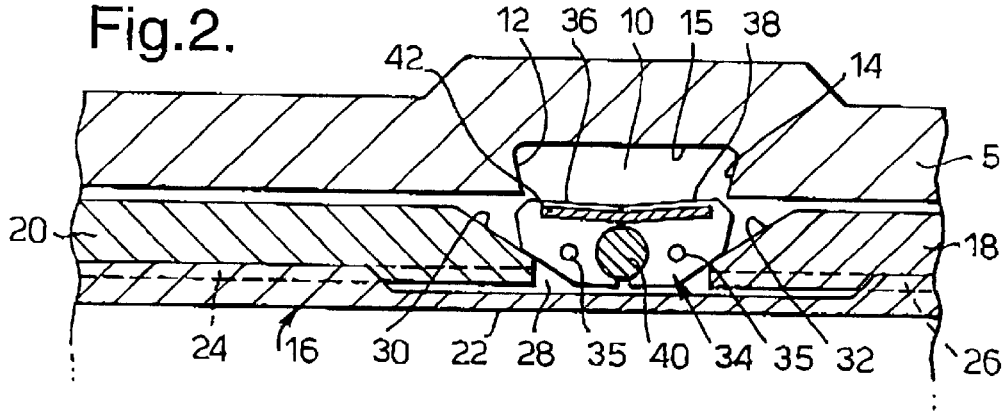
FIG. 2 shows detail A of FIG. 1 in a first mode of operation.

Referring in more detail to FIG. 2, an annular recesses 10 is formed in the casing 3 at the inner surface thereof, the recess 10 having outwardly diverging side surfaces 12, 14 arranged opposite each other and an end surface 15 extending parallel to the longitudinal axis 2.

An inner tubular element 16 is concentrically arranged within the casing 3, the inner tubular element 16 including a first actuating member 18, a second actuating member 20, and a rotatable sleeve 22 in co-operating arrangement with the first actuating member by means of a left hand threaded connection 24 and in co-operating arrangement with the second actuating member 20 by means of a right hand threaded connection 26. As shown more clearly in FIG. 2, an annular space 28 of variable length is thereby defined between the actuating members 18, 20. Thus upon rotation of the sleeve 22, the actuating members 18, 20 move relative to each other in longitudinal direction between an extended mode in which the space 28 is relatively long and a retracted mode in which the space 28 is relatively short. The location of the inner tubular element 16 relative to the recess 10 is such that the centre of space 28 is located opposite the centre of recess 10. The ends of the actuating members 18, 20 facing the space 28 have end surfaces 30, 32 diverging in outward direction.

Two or more lock members 34 (only one of which is shown) are arranged in the annular space 28, the lock members 34 being interconnected by one or more circular springs 35 acting as retracting springs keeping the lock members in place against actuating members 18, 20.

Figure 4:
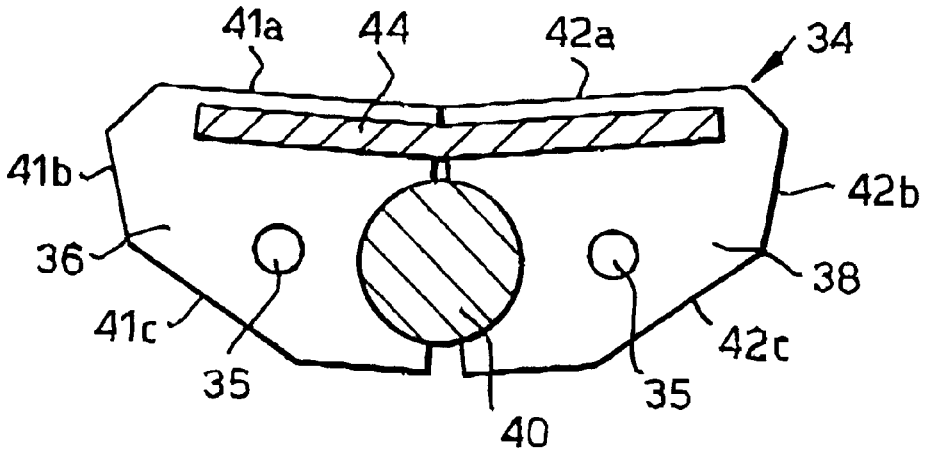
FIG. 4 schematically shows a lock member for use in the first and second embodiments.
Figure 5:
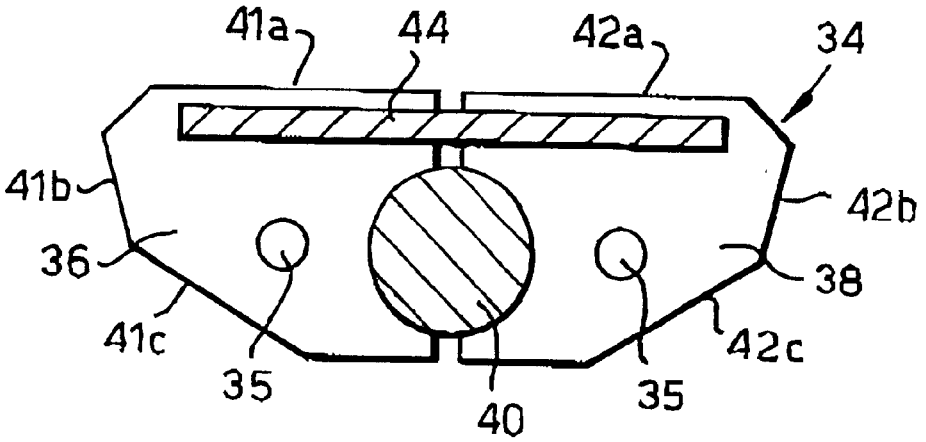
FIG. 5 shows the lock member of FIG. 4 in another mode of operation.

As shown in more detail in FIGS. 4 and 5, each lock member 34 includes a first part 36 and a second part 38, the parts 36, 38 being mutually rotatable about a rod 40 extending in circumferential direction. The rod 40 can be an integral part of one of the lock members 34. Part 36 has an outer surface 41*a,* an outer side surface 41*b,* and an inner side surface 41*c.* Part 38 has an outer surface 42*a,* an outer side surface 42*b,* and an inner side surface 42*c.*

The parts are held together by a leaf spring 44 biasing the parts 36, 38 to a retracted position in which the outer surfaces 41*a,* 42*a* extend at an angle so as to form a concave radially outer end of the lock member 34. The dimensions of the lock member 34 are such that the lock member is capable of passing into the recess 10 when the parts 36, 38 are in the retracted position.

Figure 3:
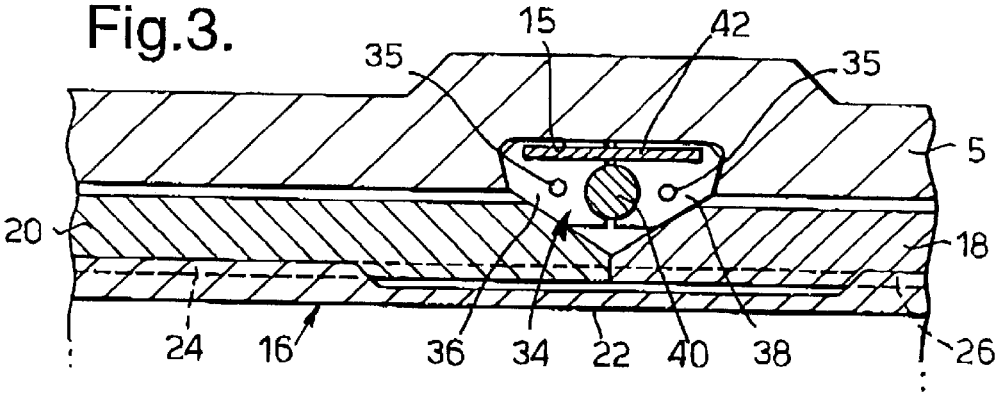
FIG. 3 shows detail A of FIG. 1 in a second mode of operation.

Referring to FIG. 3, the orientation of the outer side surfaces 41*b,* 42*b* is such that when the parts 36, 38 are rotated to an expanded position (shown in FIG. 5) in which the outer surfaces 41*a,* 42*a* are aligned, the lock member 34 fits in the recess 10 whereby the outer surfaces 41*a,* 42*a* are in contact with the radially outer surface 15 of the recess, and wherein the outer side surfaces 41*b,* 42*b* are in contact with the respective side surfaces 12, 14 of the recess 10. Furthermore, the orientation of the inner side surfaces 41*c,* 42*c* is such that when the parts 36, 38 are rotated to the expanded position the inner side surfaces 41*c,* 42*c* are in contact with the respective end surfaces 30, 32 of the actuating members 18, 20.

The second actuating member 20 is provided with an orienting/holding slot 50 (FIG. 1) for orienting and holding an actuator (not shown) in the inner tubular element 16. A wellbore tool (not shown), for example a downhole production valve or a downhole safety valve, is connected to the actuating member 18. The first actuating member 18 is internally provided with a set of primary slots 54 and the sleeve 22 is provided with a set of secondary slots 56. The actuator is adapted to engage the slot 50 and includes two parts rotatable relative to each other, each part having a set of fingers capable of gripping into the respective sets of slots 54, 56.

During normal operation the inner tubular element 16 is lowered into the wellbore casing 3 with the actuator attached thereto, and whereby the actuating members 18, 20 are in the extended mode thereby allowing the leaf spring 44 of each lock member 34 to retract the lock member parts 36, 38 to their retracted position. Lowering is stopped when the lock members 34 are positioned opposite the annular recess 10, as shown in FIG. 2. The actuator is then activated whereby the sets of fingers of the actuator grip into the respective sets of slots 54, 56. The two actuator parts are then rotated relative to each other so as to rotate the sleeve 22 in a direction that the first and second actuating members 18, 20 move relative to each other to the retracted mode. As a result the diverging end surfaces 30, 32 of the actuating members push each lock member 34 into the recess 10 whereby the outer surfaces 41*a,* 42*a* of the respective lock member parts 36, 38 contact the end surface 15 of the recess 10. Upon further rotation of the sleeve 22 the parts 36, 38 rotate relative to each other around the rod 40 until the lock member 34 becomes in the expanded position in which the outer surfaces 41*a,* 42*a* are aligned and in full contact with the end surface 15, and the outer side surfaces 41*b,* 42*b* are in full contact with the respective side surfaces 12, 14 of the recess 10. In this position the lock members 34 are locked into the recess 10.

It is thus achieved that a form fit connection between the inner tubular 16 and the casing 3 is created, which provides an excellent acoustic or electrical link. In case the wellbore tool or the inner tubular element 16 are subjected to a longitudinal force, for example due to pressure of hydrocarbon fluid flowing through the wellbore, the lock members 34 become even more firmly locked into the recess 10 due to the outwardly diverging shape of the recess 10 and lock member 34. It is thereby prevented that the connection between inner tubular element 16 and casing becomes loose or that the inner tubular element 16 collapses due to inward movement of the lock members. Furthermore, the tight connection ensures that acoustic signals for wellbore control or information transfer are adequately transferred between the inner tubular element 16 and the casing 3.

Figure 6:
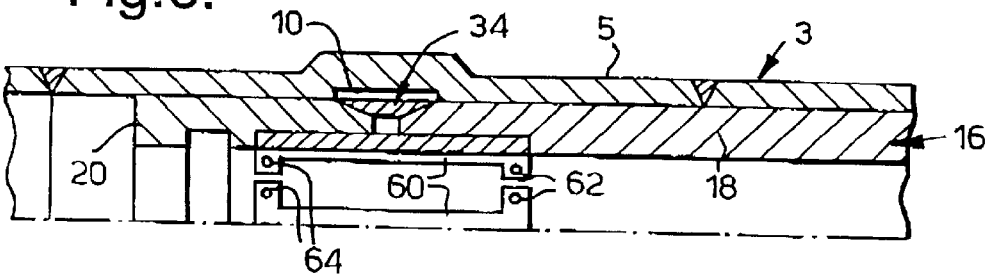
FIG. 6 schematically shows a second embodiment of a wellbore assembly according to the invention.

Reference is further made to the second embodiment of the lock assembly according to the invention, as shown in FIG. 6. The lock assembly is symmetrical with respect to longitudinal axis 58, therefore only one half of the lock assembly is shown in FIG. 6. The second embodiment is largely similar to the first embodiment, except that the sleeve for moving the actuating members 18, 20 relative to each other has been replaced by a set of shaped memory alloy actuators 60 (hereinafter referred to as SMA actuators), whereby one end of each SMA actuator 60 is fixedly connected to actuating member 18 by fasteners 62, and the other end of the SMA actuator is fixedly connected to actuating member 20 by fasteners 64. Each SMA actuator 60 has a transition temperature above which the SMA actuator has an increased length, and below which the SMA actuator has a reduced length. The sets of slots 54, 56 of the first embodiment are absent in the second embodiment.

Normal operation of the second embodiment is similar to normal operation of the first embodiment, except that instead of using the actuator tool to move the actuating members 18, 20 relative to each other, such movement is induced by contraction of the SMA actuators. This is achieved by installing a heater (not shown) in the inner tubular element 16 and operating the heater during lowering of the inner tubular element 16 into the casing so that the temperature of the SMA actuators is above the transition temperature. Thereafter the heater is turned off so that the temperature of the SMA actuators drops below the transition temperature whereby the SMA actuators contract and thereby move the actuating members 18, 20 to their retracted mode.

What is claimed is:

1. A lock assembly for locking an outer tubular element to an inner tubular element extending through the outer tubular element, the assembly comprising a lock mandrel connected to one of said tubular elements and being provided with a recess facing the other one of said tubular elements, the bottom of the recess having a greater cross-sectional width than the top of the recess, a lock member arranged between the first and second tubular elements in a locking relationship with the other one of the tubular elements, the lock member extending into said recess and being operable between a retracted mode in which the lock member is movable relative to the recess and an expanded mode in which the lock member is expanded within the recess, the assembly further comprising an actuator means for expanding the lock member in said recess.

2. The lock assembly of claim 1, wherein the lock mandrel is connected to the outer tubular element.

3. The lock assembly of claim 2 wherein the lock member includes a first part and a second part rotatable relative to the first part about an axis extending substantially in circumferential direction, and wherein the lock member is operable between the retracted mode and the expanded mode by rotating said parts relative to each other.

4. The lock assembly of claim 3, further comprising spring means biasing said parts to the retracted mode.

5. The lock assembly of claim 4, wherein the actuator means comprises a first actuator member and a second actuator member, the actuator members being movable relative to each other in longitudinal direction of the tubular elements and being arranged so as to rotate said parts relative to each other upon said relative movement of the actuator members, and a control device for controlling said relative movement of the actuator members.

6. The lock assembly of claim 5, wherein the first actuator member is in contact with said first part at a primary contact surface, and the second actuator member is in contact with said second part at a secondary contact surface, said contact surfaces diverging in radial direction towards said recess.

7. The lock assembly of claim 6, wherein the control device comprises a rotatable sleeve in co-operating arrangement with the first actuator member by means of a left hand thread connection and in co-operating arrangement with the second actuator member by means of a right hand thread connection.

8. The lock assembly of any one of claim 7, wherein the actuator means comprises a memory metal element interconnecting the first and second actuator members and being operable between a longitudinally retracted mode and a longitudinally extended mode.

9. The lock assembly of any one of claims 8, wherein said tubular elements are arranged in a wellbore formed in an earth formation.

* * * * *